US009163370B2

(12) United States Patent
Qiu

(10) Patent No.: US 9,163,370 B2
(45) Date of Patent: Oct. 20, 2015

(54) FOLDABLE PICKUP DEVICE

(71) Applicant: Bin Qiu, Jiangsu (CN)

(72) Inventor: Bin Qiu, Jiangsu (CN)

(73) Assignee: Jiangsu Zhongheng Pet Supplies Co., Ltd., Jiangsu (CN)

( * ) Notice: Subject to any disclaimer, the term of this patent is extended or adjusted under 35 U.S.C. 154(b) by 0 days.

(21) Appl. No.: 14/090,475

(22) Filed: Nov. 26, 2013

(65) Prior Publication Data

US 2014/0203579 A1 Jul. 24, 2014

(51) Int. Cl.
*A01K 29/00* (2006.01)
*E01H 1/12* (2006.01)

(52) U.S. Cl.
CPC ..... *E01H 1/1206* (2013.01); *E01H 2001/1293* (2013.01)

(58) Field of Classification Search
CPC ..... E01H 1/1206; E01H 2001/1293; A01K 23/005
USPC ..... 294/1.3–1.5, 50.8, 115, 209; 15/257.1, 15/257.2, 257.6; 119/161, 858, 867
See application file for complete search history.

(56) References Cited

U.S. PATENT DOCUMENTS

| | | | | |
|---|---|---|---|---|
| 4,248,468 | A * | 2/1981 | Hastings | 294/1.4 |
| 5,503,442 | A * | 4/1996 | Lee | 294/1.4 |
| 6,983,966 | B2 * | 1/2006 | Azrikam | 294/1.4 |
| 7,686,361 | B1 * | 3/2010 | Flinn | 294/1.4 |
| 8,235,434 | B2 * | 8/2012 | Lipscomb et al. | 294/1.4 |
| 2008/0265592 | A1 * | 10/2008 | Askinasi | 294/1.4 |
| 2008/0303296 | A1 * | 12/2008 | Waltz | 294/1.4 |

FOREIGN PATENT DOCUMENTS

CN 200920256496 8/2010

* cited by examiner

*Primary Examiner* — Stephen Vu
(74) *Attorney, Agent, or Firm* — Hauptman Ham, LLP

(57) ABSTRACT

A foldable pet feces pickup device includes a handle, upper operating stick, and a lower operating stick. The device further includes a linkage accessory connecting the upper operating stick to the lower operating stick. The linkage accessory has an elongated shape with round convex parts. The device further includes a pair of picking-up members for picking up an object; and a shaft connecting the lower operation stick and the pair of picking-up members. If the upper operating stick is moved toward the handle, the pair of picking-up members moves away from each other to open. If the upper operating stick is moved away from the handle, the pair of picking-up members moves toward each other to close. The device is foldable at the linkage portion.

13 Claims, 2 Drawing Sheets

FOLDABLE PICKUP DEVICE

CROSS REFERENCE TO RELATED APPLICATION

The present application is based on, and claims priority from, Chinese Application Number 201320053898.X, filed Jan. 19, 2013, the disclosure of which is incorporated herein in its entirety.

TECHNICAL FIELD

The present disclosure relates generally to a pickup device, and specifically to a foldable pickup device for picking up an object, e.g., pet feces.

BACKGROUND

China's industrial development has been gradually moving toward the direction of intensive, energy conservative and low-carbon. With the development of society and the improvement of living standards, people are constantly in pursuit of spiritual life; while they are enjoying their material life. Raising pets can bring a lot of happiness to the keepers; and add fun to their life. However, the cleanup for pet wastes has brought much inconvenience due to the limitations of living environments. In this context, the foldable pet feces pickup device (Patent No. ZL200920256496.3) has made cleaning work more convenient. It helps to alleviate the sufferings of patients with lumbar diseases and the difficulties for the old people to bend and stoop. Nevertheless, following a long period of use, this foldable pet feces pickup device would bring inconvenience to the pet keepers, such as the issues of rope wearing off, breakage, repair, and inconveniences associated with rope repair and replacement. In order to solve these problems, many pet lovers have made improvements. Although some progress has been made, they all so far failed to completely solve these problems.

SUMMARY

In order to overcome the aforementioned shortcomings, one or more objects of one or more embodiments of the present disclosure is to provide a foldable pet feces pickup device including an operating stick. The operating stick can directly control the opening and closing of the picking-up plates. The foldable pet feces pickup device further includes a linkage accessory. Thus, the operation and maintenance of the foldable pet feces pickup device are easy, because the foldable pet feces pickup device avoids issues associated with rope breakage, repair and/or replacement. In this way, the product life of such pickup device is extended. Further, the foldable pet feces pickup device includes a locking button configured to be fastened in a button hole. Thus, it is convenient to use, store, and transport the foldable pet feces pickup device.

In an aspect, a foldable device for picking up pet feces includes a handle; an upper operating stick; covers; a fixation sleeve; button holes; a linkage accessory; locking buttons; a lower operating stick; a connecting rod; a rod base; springs; a rotating shaft; a picking-up plate; and a plurality of teeth.

The upper operating stick has a handle disposed on an outer side of the upper operating stick. Certain round holes are located at two sides of the bottom of the upper operating stick, at two sides of the bottom of the handle, at two sides of the top of the lower operating stick and at two sides of the top of the rod base.

The linkage accessory connects the upper operating stick and the handle to the lower operating stick and the rod base through the round holes. The linkage accessory is an elongated shape and has top and bottom portions provided with round convex parts.

The covers are located at both front and back sides of the upper operating stick, the handle, the lower operating stick and the rod base. A fixation sleeve is arranged to be outside of the covers. The fixation sleeve has a bottom portion including button holes at both front and back sides of the fixation sleeve. The covers have bottom portions including the locking buttons at both front and back sides of the covers.

The rotating shaft has two ends connected with two branches of the rod base. The picking-up plates are symmetrical and each of the picking-up plates has a spoon-shape. The tops of the picking-up plates are connected to each other through the rotating shaft. The two picking-up plates have corresponding teeth engagable with each other.

The lower operating stick is connected to a middle portion of the connecting rod. The lower operating stick is connected to the middle portion of the rotating shaft through the springs. Two ends of the connecting rod are connected with central parts of the tops of the two picking-up plates correspondingly by hinges.

The foldable pet feces pickup device is operated by employing the operating sticks to directly control the opening and closing of the picking-up plates. Thus, the foldable pet feces pickup device can be easily operated. During the operation, the locking buttons are firmly fastened with the corresponding button holes. The linkage accessory is sheathed inside the fixation sleeve to keep the main rod in a linear state. When pulling the upper operating stick upward, the lower operating stick will drive the connecting rod to move upward accordingly so as to open the picking-up plates. Directing the pick-up plates to the pet feces, release upper operating stick and the picking-up members will close to complete the cleaning. When the pickup device is not in use, the locking buttons will be released from the respective button holes, and the fixation sleeve will be removed from the linkage accessory. Then the main rod can be folded. Therefore, the device only needs a small space to store and is very easy to be carried, stored or transported.

The structure of the foldable pet feces pickup device is simple and reasonable. With employing operating stick to directly control the opening and closing of the picking-up plates, it has extended the service life of the pickup device, and with easy maintenance and operation in at least some embodiments. After being folded, the foldable pet feces pickup device only requires a small space for storage. Thus, in at least some embodiments, the foldable pet feces pickup device can be easily carried and stored and reduce transportation and warehousing costs.

BRIEF DESCRIPTION OF THE DRAWINGS

The present disclosure will be further described in conjunction with drawings and embodiments.

DETAILED DESCRIPTION

One or more embodiments of a foldable pickup device will be explained with reference to FIGS. 1 and 2.

Figure 1:
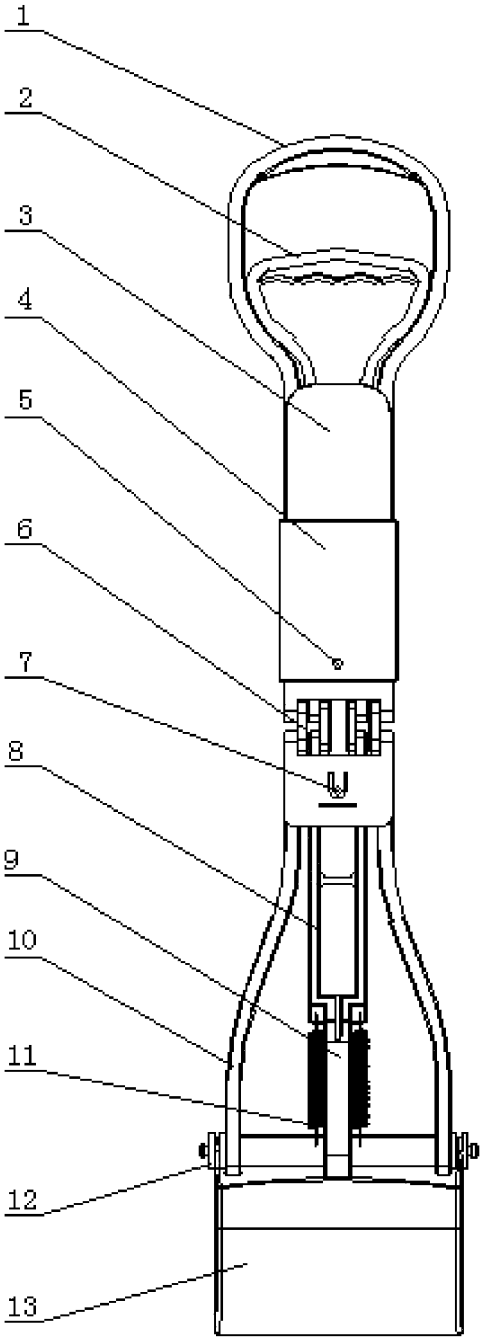
FIG. 1 is a front view of an embodiment of the foldable pet feces pickup device.
Figure 2:
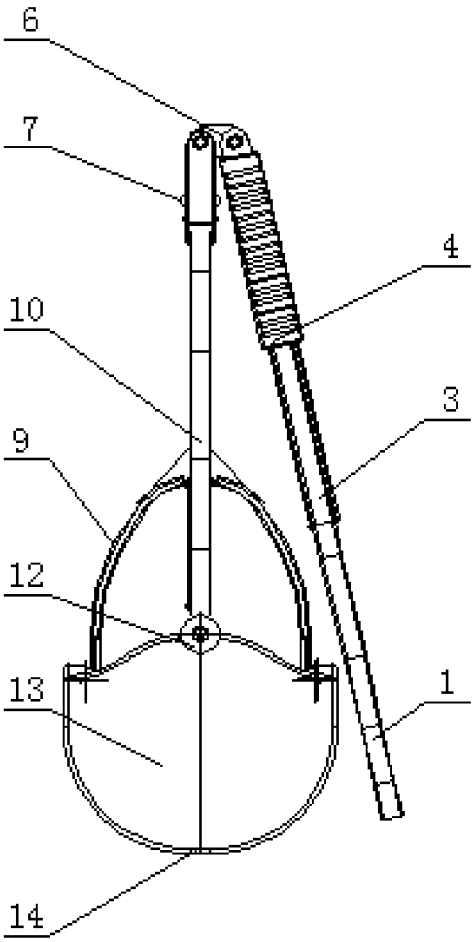
FIG. 2 is side view of an embodiment of the foldable pet feces pickup device in a folded state thereof.

In reference to FIGS. 1 and 2, the foldable pickup device 100 includes an upper operating stick 2 and a handle 1 arranged in an inner side of the upper operating stick 2. Openings are located at two sides of the bottom of the upper operating stick 2, at two sides of the bottom of the handle 1, at two sides of the top of the lower operating stick 8 and at two sides of the top of the rod base 10. In at least one embodiment, the openings are round holes.

Linkage accessory 6 connects the upper operating stick 2, the handle 1, respectively, to the lower operating stick 8 and the rod base 10 through the openings. The linkage accessory 6 is an elongated member having top and bottom portions provided with round convex parts. The covers 3 are located at both front and back sides of the upper operating stick 2, the handle 1, the lower operating stick 8 and the rod base 10. A pair of fixation sleeves 4 cover the covers 3 correspondingly. The fixation sleeves 4 have button holes 5 at both front and back sides, for example, at the bottom portions of the fixation sleeves 4. The covers 3 have the locking buttons 7 at both front and back sides of their bottoms and configured to be locked in the corresponding button holes 5 of the fixation sleeves 4.

Further as shown in FIGS. 1-2, the foldable pet feces pickup device further includes a rotating shaft 12. The rotating shaft has two ends which are respectively connected with two branches of the rod base 10. Two symmetrical and spoon-shaped picking-up members 13 are connected to each other through the rotating shaft 12. The two picking-up members 13 define a closed space to store pet feces picked up by the device. The two picking-up members 13 have corresponding teeth 14 configured to engage with each other when the picking-up members 13 are closed, also referred to as a closed state.

Further, the foldable pet feces pickup device includes a lower operating stick 8 opposite to the upper operating stick 2. The lower operating stick 8 is connected to the middle of the connecting rod 9 and the middle of the rotating shaft 12 through the springs 11. The connecting rod 9 has two ends connected with a central part of the top portion of the two picking-up plates 13 by hinges.

By employing operating sticks to directly control the opening and closing of the picking-up members 13, the device can be easily operated and maintained. During the operation, the locking buttons 7 are firmly fastened with their corresponding button holes 5 of the fixation sleeves 4. The linkage accessory 6 is sheathed by the fixation sleeve 4 to maintain the main rod straight in a linear form, e.g., in an unfolded (or in-use) state. If the the upper operating stick 2 is pulled upward, the lower operating stick 8 drives the connecting rod 9 to move upward so as to open the picking-up plates 13, also referred to as an open state. Using the picking-up members 13 to pick up the pet feces, and releasing the upper operating stick 2 so as to close the picking-up members 13 and complete the cleanup work. If the foldable pet feces pickup device is not in use, the locking buttons 7 are released from the corresponding button holes 5 so as to unlock the fixation sleeves 4 from the covers 3. Thus, the fixation sleeve 4 is slidable from interacting with the locking button. Thus, the linkage accessory 6 can be exposed. Then, the main rod is foldable onto itself from the front or the back of the device. Therefore, only a small space is required to store the foldable pet feces pickup device, in at least some embodiments, the foldable pet feces pickup device is very easy to be carried, stored or transported.

What is claimed is:

1. A foldable device for picking up an object, comprising:
a handle;
an upper operating stick movable relative to the handle;
a linkage portion;
a lower operating stick connected to the upper operating stick through the linkage portion;
a pair of picking-up members for picking up an object;
a shaft connecting the lower operating stick and the pair of picking-up members;
a cover for covering the upper operating stick and lower operating stick; and
a sleeve slidable along the upper operating stick to cover the linkage portion,
wherein
the pair of picking-up members is configured to move away from each other to open responsive to the upper operating stick being moved toward the handle,
the pair of picking-up members is configured to move toward each other to close responsive to the upper operating stick being moved away from the handle,
the device is foldable at the linkage portion,
the cover has an upper portion and a lower portion connected to the upper portion with the linkage portion, and
the lower portion of the cover comprises a locking button, and the sleeve comprises a hole configured to receive the locking button of the cover to maintain the upper and lower operating sticks in a linear form.

2. The foldable device according to claim 1, wherein said linkage accessory is an elongated piece having protruding parts at top and bottom of the elongated piece.

3. The foldable device according to claim 1, further comprising a rod base connected to the handle through the linkage accessory.

4. The foldable device according to claim 1, wherein the pair of pick-up members are symmetrical and connected to each other through said shaft.

5. The foldable device according to claim 1, wherein each of the pick-up members comprises teeth that are engagable with each other.

6. The foldable device according to claim 1, further comprising a connecting rod connecting the lower operating stick to the pair of picking-up members, wherein the connecting rod has two ends connected to the two picking-up members by hinges.

7. The foldable device according to claim 1, further comprising
a rod base connected to the handle through the linkage portion, and
a rotating shaft having two ends which are respectively connected with two branches of the rod base.

8. A foldable device for picking up an object, comprising:
a handle;
an upper operating stick movable relative to the handle;
a lower operating stick connected to the upper operating stick; and
a pair of picking-up members connected to the lower operating stick for picking up an object;
a linkage portion connecting the upper operating stick to the lower operating stick, wherein the device is foldable at the linkage portion;
a cover for covering the upper and lower operating sticks; and
a sleeve slidable along the upper operating stick to cover the linkage portion,
wherein
the upper operating stick is configured to be moved away from the lower operating stick to cause the pair of picking-up members to open,
the upper operating stick is configured to be moved toward the lower operating stick to cause the pair of picking-up members to close, and a lower portion of the cover comprises a locking button, and the sleeve comprises a hole configured to receive the locking button of the cover to maintain the upper and lower operating sticks in a linear form.

9. The foldable device according to claim 8, wherein said linkage portion is an elongated piece having protruding parts at top and bottom of the elongated piece.

10. The foldable device according to claim 8, further comprising a rod base connected to the handle through the linkage portion.

11. The foldable device according to claim 8, wherein the pair of picking-up members are symmetrical.

12. The foldable device according to claim 11, wherein each of the picking-up members comprises teeth that are engagable with each other.

13. The foldable device according to claim 8, further comprising a connecting rod connecting the lower operating stick to the pair of picking-up members, wherein the connecting rod has two ends connected to the two picking-up members by hinges.

* * * * *